United States Patent [19]

Erickson

[11] Patent Number: 4,604,116

[45] Date of Patent: Aug. 5, 1986

[54] HIGH PRESSURE OXYGEN PUMPED LOX RECTIFIER

[76] Inventor: Donald C. Erickson, 627 Ridgely Ave., Annapolis, Md. 21401

[21] Appl. No.: 583,817

[22] Filed: Feb. 27, 1984

Related U.S. Application Data

[63] Continuation-in-part of Ser. No. 416,980, Sep. 13, 1982, Pat. No. 4,433,989.

[51] Int. Cl.[4] ..... F25J 3/04

[52] U.S. Cl. ..... 62/13; 62/22; 62/28; 62/30; 62/31; 62/33; 62/34; 62/42

[58] Field of Search ..... 62/22, 23, 24, 27–34, 62/13, 38, 39, 42

[56] References Cited

U.S. PATENT DOCUMENTS 2,280,383 4/1942 DeBaufre ..... 62/29

4,433,989 2/1984 Erickson ..... 62/13

*Primary Examiner*—Frank Sever

[57] ABSTRACT

A process and apparatus are disclosed for producing pressurized oxygen at up to about 10 ATA directly in a cryogenic distillation process without need of an oxygen compressor. The process involves a split supply pressure air supply wherein the elevated pressure fraction gasifies pumped liquid oxygen. An essential aspect of the invention is that this gasification takes place in an elevated pressure rectifier; thus the elevated pressure fraction of air is converted into partially separated liquids as opposed to the more wasteful conversion to liquid air which occurs in the conventional process. The improvement may be adapted to any cryogenic distillation configuration and be used to produce any purity of product oxygen. A particularly high purity (99.5%) and low energy example is presented.

15 Claims, 3 Drawing Figures

HIGH PRESSURE OXYGEN PUMPED LOX RECTIFIER

This is a continuation-in-part of Ser. No. 416,980, filed Sept. 13, 1982 now U.S. Pat. No. 4,433,989.

DESCRIPTION

1. Technical Field

This invention relates to processes and apparatus for the separation by subambient distillation of mixtures of non-condensible gases such as air, wherein one component such as oxygen is required at a delivery pressure higher than that normally available from the conventional cryogenic distillation process.

Pressurization of product oxygen to elevated use pressure via compressor is both inefficient and potentially hazardous. Pressurization schemes involving pumping and subsequent gasification of liquid oxygen are safer but even less efficient. Thus, a need exists for a pumped LOX system at least as efficient as the $O_2$ compression system.

This application is a continuation-in-part of U.S. Pat. No. 4,433,989, which is incorporated by reference.

2. Background Art

The prior art for this invention, relating to production of high pressure oxygen, appears in the following two technical articles: "The Production of High-Pressure Oxygen" by Helmut Springmann, *Linde Reports on Science and Technology,* 31/1980, Linde, A. G.; and "Large Oxygen Plant Economics and Reliability", by William J. Scharle, Tennessee Valley Authority Publication TVA Y 143, July 1979, pages 98–108. The former article describes the hazardous nature and relatively low efficiency of oxygen compressors relative to air compressors (e.g., 66% vice 76% efficiency for very high delivery pressures) due to the lower ignition temperature of metals in pressurized oxygen. Both articles describe alternative "pumped LOX" cycles wherein liquid oxygen is pumped to high pressure and then gasified against condensing supply air at high pressure. Both articles characterize this as a less hazardous yet markedly less efficient (8% less) approach to pressurized oxygen. The inefficiency of the "Pumped LOX" cycles utilizing split feed air pressures is due to the fact that the prior art cycles wastefully condense the higher pressure fraction of supply air directly to liquid air, as opposed to the combination of liquid nitrogen and oxygen enriched (~41%) liquid which is obtained from the lower pressure fraction in the HP portion of the dual pressure column. Thus, since less separation is achieved in the liquid supplied to the LP column, i.e., less reflux $N_2$ liquid is available and the enrichment of the oxygen enriched liquid is lower, there will be correspondingly less separation, and hence recovery and/or purity achieved in the LP column. U.S. Pat. No. 3,500,651 discloses a pumped LOX configuration using a single pressure distillation column.

Various triple (or more than three) pressure air distillation configurations have been disclosed in the prior art, such as in U.S. Pat. Nos. 1,880,981, 2,699,046, 2,817,216, and 3,079,759. Some are adapted to lower the energy requirement, such as U.S. Pat. Nos. 3,688,513, 4,254,629, 4,356,013, and 3,563,047. The latter three involve a split supply pressure, although not for the purpose of high pressure gasification of pumped LOX.

Other advantageous low energy flowsheets are disclosed in U.S. application Ser. No. 501,264 filed June 6, 1983 by the present applicant, which disclosure is incorporated by reference.

DISCLOSURE OF INVENTION

The needed improvement in the production of pressurized oxygen can be obtained by the provision of apparatus or process steps which cause an elevated pressure fraction of supply air to condense against boiling pressurized LOX in a rectifier so as to yield two separate liquid streams, one of nearly pure $N_2$ and the other of enriched oxygen liquid, thereby making the liquid $N_2$ available as reflux in the remaining distillative apparatus, as well as providing an enriched oxygen feed. Thus, the remaining distillations will yield greater separation (or alternatively require fewer stages or lesser reflux) than when they are supplied simply with liquified air.

The needed pressurized oxygen production improvement is fulfilled by providing an auxiliary elevated pressure column (rectifier) which receives the elevated pressure fraction of air (i.e., the fraction compressed to a pressure higher than the high pressure) and which is refluxed by indirect heat exchange with the boiling pressurized LOX. The elevated pressure air is introduced near the bottom, and liquid $N_2$ is withdrawn from the top and enriched oxygen liquid is withdrawn from the bottom. This elevated pressure auxiliary column can be combined with any desired distillation arrangement for treating the remaining fraction of air, e.g., with a conventional dual pressure column. Thus, the liquid $N_2$ from the elevated pressure column adds to the reflux available to the remaining distillation apparatus, providing greater separation power. The enriched oxygen liquid from the elevated pressure rectifier can advantageously be routed through the high pressure rectifier where it would undergo slight additional enrichment prior to introduction to the LP column. Similarly the liquid $N_2$ stream from the elevated pressure rectifier may be routed via the top portion of the HP rectifier enroute to the $N_2$ removal column, so as to allow further purification of the $LN_2$ reflux stream. Mechanical energy could advantageously be recovered from the depressurization of either or both liquid streams.

Substantial gas will be generated in depressurizing the enriched oxygen liquid and the liquid $N_2$ to HP column pressure, and a two phase expander can be used to generate refrigeration from these streams, thus reducing the need for additional refrigeration.

Since the higher pressure distillation column relies on evaporation and condensation for its functioning, it is limited to a pressure below the critical pressure of nitrogen, and, in practice to below about 28 ATA. This limits the maximum $O_2$ production pressure to approximately 10 ATA by this process, when the reflux-reboil heat exchange temperature differential is accounted for.

The pressurized oxygen production improvement described above will provide much greater separation power than the prior art pumped LOX processes, but there will still be some reduction in separation power as opposed to a process producing only low pressure gaseous oxygen.

Fortunately, the conventional dual pressure process has more separation power than it needs, and can still achieve relatively good separation in conjunction with the relatively less efficient conventional pumped LOX flowsheets. Thus the disclosed improvement provides relatively minor improvements in conjunction with conventional dual pressure processes, e.g., FIG. 2.

However the more recent low energy flowsheets have typically converted any spare separation power into energy savings, and thus it becomes virtually mandatory that the more efficient approach to pressurized oxygen from pumped LOX disclosed herein be used with those flowsheets.

The conventional pumped LOX configuration disclosed variously in the prior art can be adapted to any air distillation process or arrangement which normally produces low pressure gaseous oxygen, by withdrawing the low pressure oxygen from the host distillation process as liquid vice gas, and returning a corresponding amount of liquid air to the distillation process in compensation, i.e., to balance the refrigeration requirement. Correspondingly, the newly disclosed improved pumped LOX process can be applied to any air distillation process which normally produces low pressure gaseous oxygen. As above, liquid vice gaseous oxygen is withdrawn from the host process; however, instead of returning liquid air in compensation, an equivalent amount of liquid nitrogen plus oxygen enriched liquid is returned to the host process. Thus the net savings of the improved process is represented by the entropy of mixing in combining liquid $N_2$ plus oxygen enriched liquid into the corresponding amount of liquid air.

In summary, the disclosed improvement is a cryogenic distillation process (or apparatus for practice of the process) for producing oxygen at a product pressure of up to about 10 ATA comprising:

(a) supplying a fraction of air that has been cleaned and cooled to near its dewpoint at an elevated pressure that is at least approximately $2\frac{1}{2}$ times the oxygen product pressure to an elevated pressure rectification column;

(b) rectifying the elevated pressure air to a liquid $N_2$ overhead product and an oxygen enriched liquid bottom product;

(c) refluxing the elevated pressure rectifier by latent heat exchange with boiling pressurized liquid oxygen, whereby gaseous oxygen at product pressure is obtained;

(d) supplying said liquid nitrogen, said oxygen enriched liquid, plus a remaining fraction of air at a high pressure that is at least 2 ATA lower than said elevated pressure to a cryogenic distillation apparatus;

(e) distilling said fluids from step (d) so as to obtain low pressure liquid oxygen;

(f) pressurizing said low pressure liquid oxygen for use in step (c).

BEST MODE FOR CARRYING OUT THE INVENTION

Figure 1:
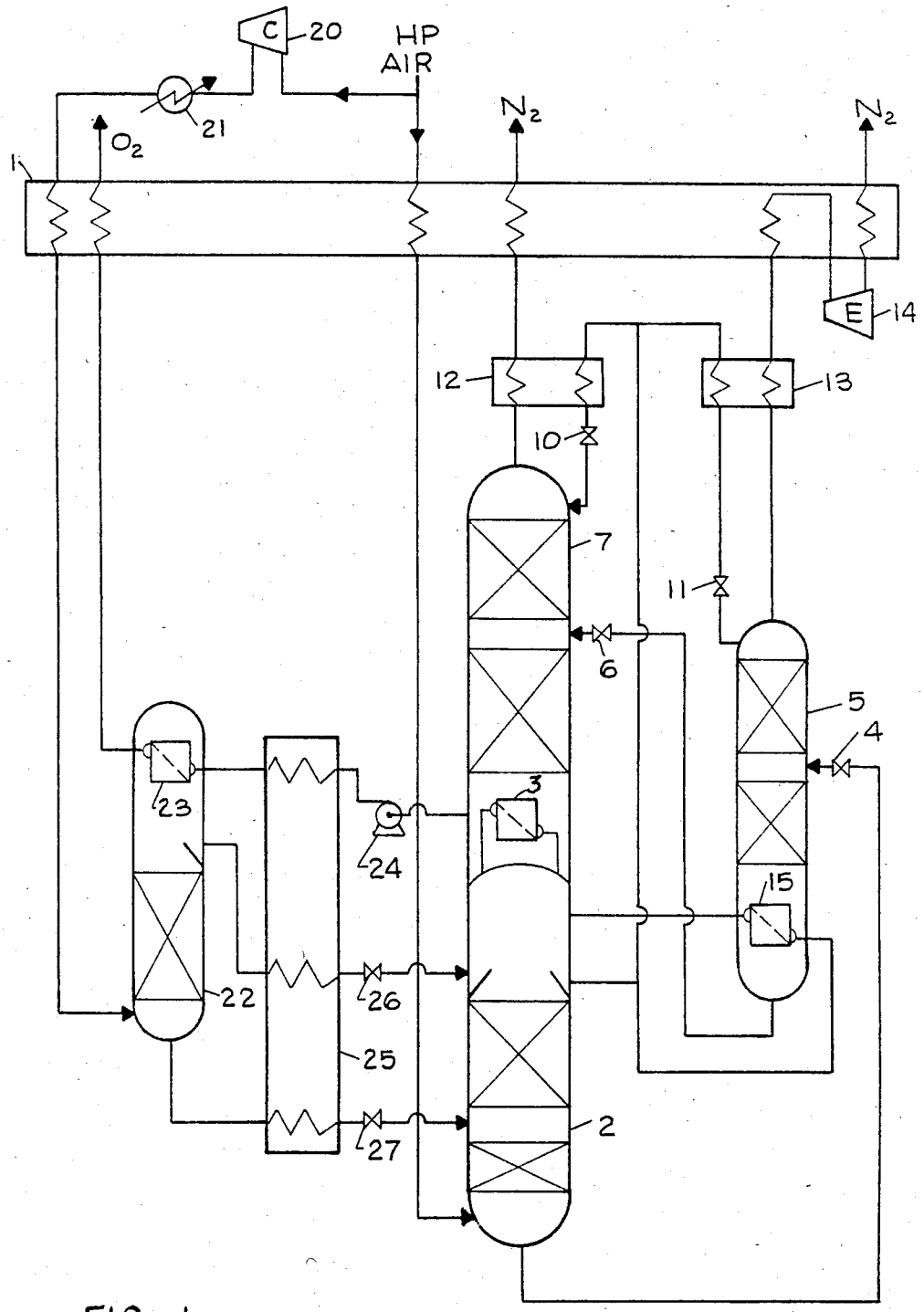
FIG. 1 illustrates a process combining the elevated pressure rectifier improvement with the medium pressure enrichment flowsheet disclosed in the parent application.

Referring to FIG. 1, cleaned, pressurized air is supplied via heat exchange apparatus 1 to the high pressure rectification section 2 of a dual pressure column. That column is refluxed by reflux condenser 3, yielding liquid nitrogen at the top and approximately 41% oxygen enriched liquid at the bottom. The latter stream is routed through pressure reduction means 4 (and also optionally through sensible heat exchange devices) into medium pressure column 5. There it is distilled into a relatively pure overhead gaseous nitrogen (>98%) and further enriched bottom product liquid. The MP column is reboiled by indirect exchange of heat with condensing gas from the HP column which may be from an intermediate height or from the overhead as illustrated. With the HP column top at 6.4 ATA (1 ATA equals 1.013 bar) and 97.7 K, and a 2 K $\Delta T$ across both reflux/-reboilers, the MP column bottom will be at 95.7 K, 3.55 ATA, and 54 mole percent $O_2$ liquid. That liquid is routed via optional means for sensible heat exchange to means for pressure reduction 6. That fluid is eventually routed to LP column 7; however, if an auxiliary argon removal column is present, it is routed via the top reflux section of such a column. Somewhat more than half of the 54% $O_2$ liquid would thus be gasified to a mixture of approximately 70% liquid and 40% vapor at 90 K and 1.75 ATA. The argon column overhead thus operates at 92 K, 1.5 ATA, and at least 70% argon. The argon product is then further purified before final delivery.

The liquid $N_2$ produced in refluxer 3 (and 15, if applicable) is split between and directly injected into columns 5 and 7 as reflux via the means for pressure reduction 10 and 11. Those streams would normally be sensibly cooled by heat exchange with gaseous overhead $N_2$ in heat exchangers 12 and 13 before injection as reflux. The gaseous $N_2$ from column 5, which amounts to approximately 27% of the molar feed air supply rate in this example, is further warmed and then work expanded in expansion device 14, thereby providing process refrigeration. The heat exchanger 1 can be any known type—reversing, pebble bed, etc., to suit product requirements or local conditions. The means for pressure reduction 4, 6, 10, and 11 can be any of J-T valves or orifices, control valves, hydraulic expanders, or the like.

Part of the feed air, between 15 and 45%, is further compressed to an elevated pressure in compressor 20, and then cooled (plus otherwise cleaned, if necessary) in cooler-cleaner 21, and further regeneratively cooled to near its dewpoint in heat exchanger 1. It is introduced near the bottom of elevated pressure rectifier 22. This column is refluxed by indirect heat exchange with boiling pressurized liquid oxygen in refluxer 23. The pressurized LOX is obtained from LP column 7 via pump 24 and heat exchanger 25. The elevated pressure air is thus distilled into two liquid streams: liquid $N_2$ and oxygen enriched liquid. These streams exchange sensible heat with the previously mentioned LOX in heat exchanger 25, and then are let down in pressure via means for pressure reduction 26 and 27. The enriched oxygen liquid is expanded into HP rectifier 2 for slight further enrichment, while the liquid $N_2$ can be used directly as reflux in column 7. Alternatively the liquid $N_2$ can be expanded into the top portion of HP rectifier 2.

Predicated on a 2 K temperature differential in refluxer 23, the following approximate pressure relations will prevail in the elevated pressure rectifier: 4 ATA (atmospheres absolute) $O_2$ product requires 12.8 ATA elevated pressure air; 7 ATA $O_2$ requires 18 ATA; and 10 ATA $O_2$ requires 28 (vice 27) ATA air. Since the extra energy required by this technique is only the incremental compression above the high pressure level (typically between 4 and 7 ATA), the required pressure ratio for this increase is much less than that required alternatively by an $O_2$ compressor. This compensates for the fact that somewhat more air than $O_2$ must be so compressed. Considering the added advantage that air compressors are more efficient, safe, and less costly than $O_2$ compressors, this pumped LOX with higher pressure distillation is more advantageous than compressed $O_2$ systems for $O_2$ pressures up to 10 ATA even without a two phase expander.

Figure 2:
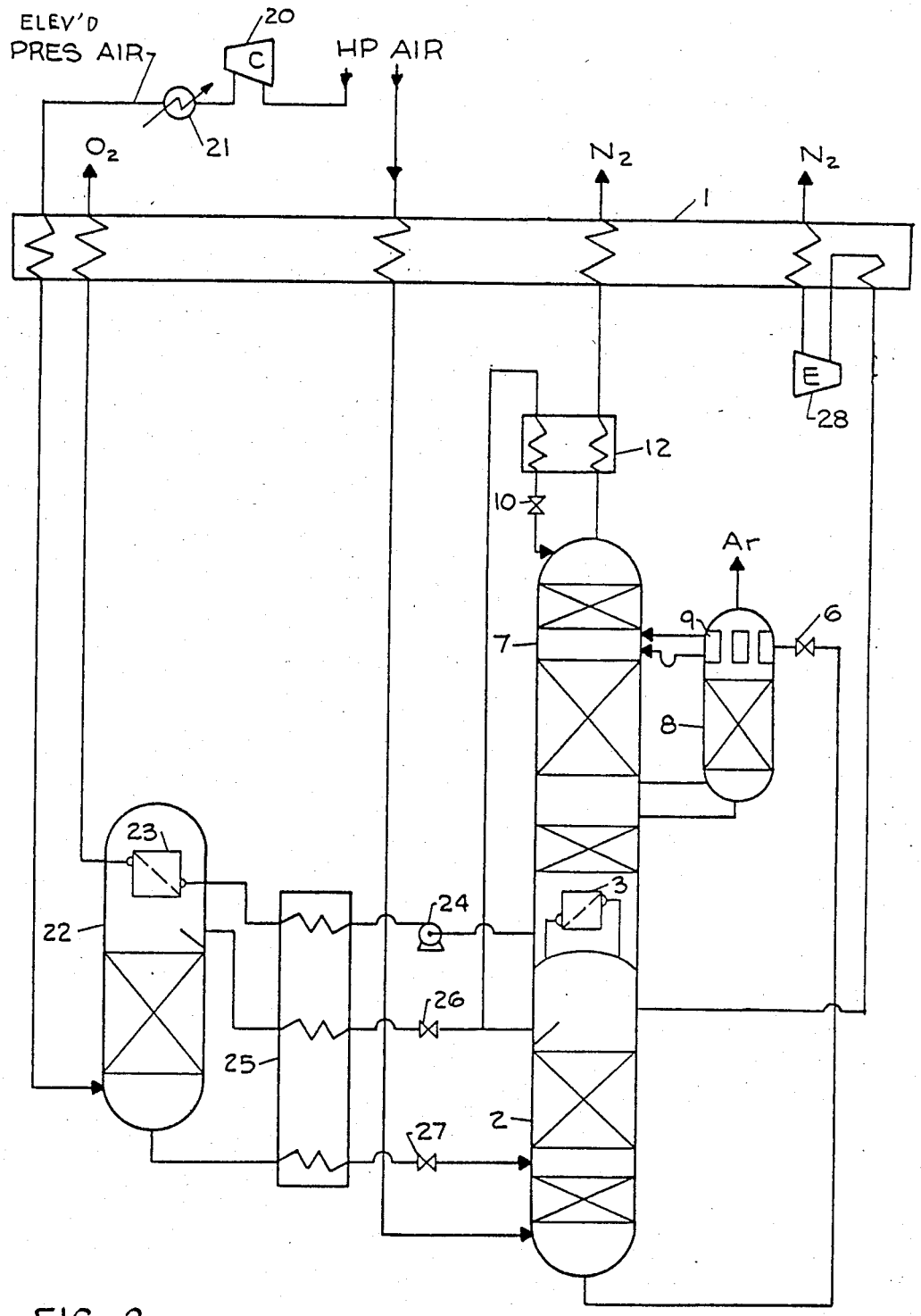
FIG. 2 illustrates a conventional dual pressure column process incorporating an elevated pressure rectifier for gasification of pressurized pumped LOX (liquid oxygen).

Alternative or additional sensible heat exchangers could be expected to be applied to the FIG. 1 flowsheet in specific cases, e.g., using some gaseous $N_2$ to provide further cooling to the liquid streams from the elevated pressure column. Also many other variations are possible within the scope of the disclosure, e.g., details of the remaining subambient distillation process. An example of this is FIG. 2, wherein the pumped LOX with higher pressure distillation is combined with a conventional dual pressure column. The numbered components in FIG. 2 correspond to the same numbered components in FIG. 1. The auxiliary argon removal column has been deleted from FIG. 2 to more clearly illustrate the novel aspects of the disclosure, even though an argon removal column would frequently be used in conjunction with such a column. Without the auxiliary column, the flowsheet would be limited to producing medium purity (98% or less) $O_2$, but with it production of high purity pressurized $O_2$ is possible.

Figure 3:
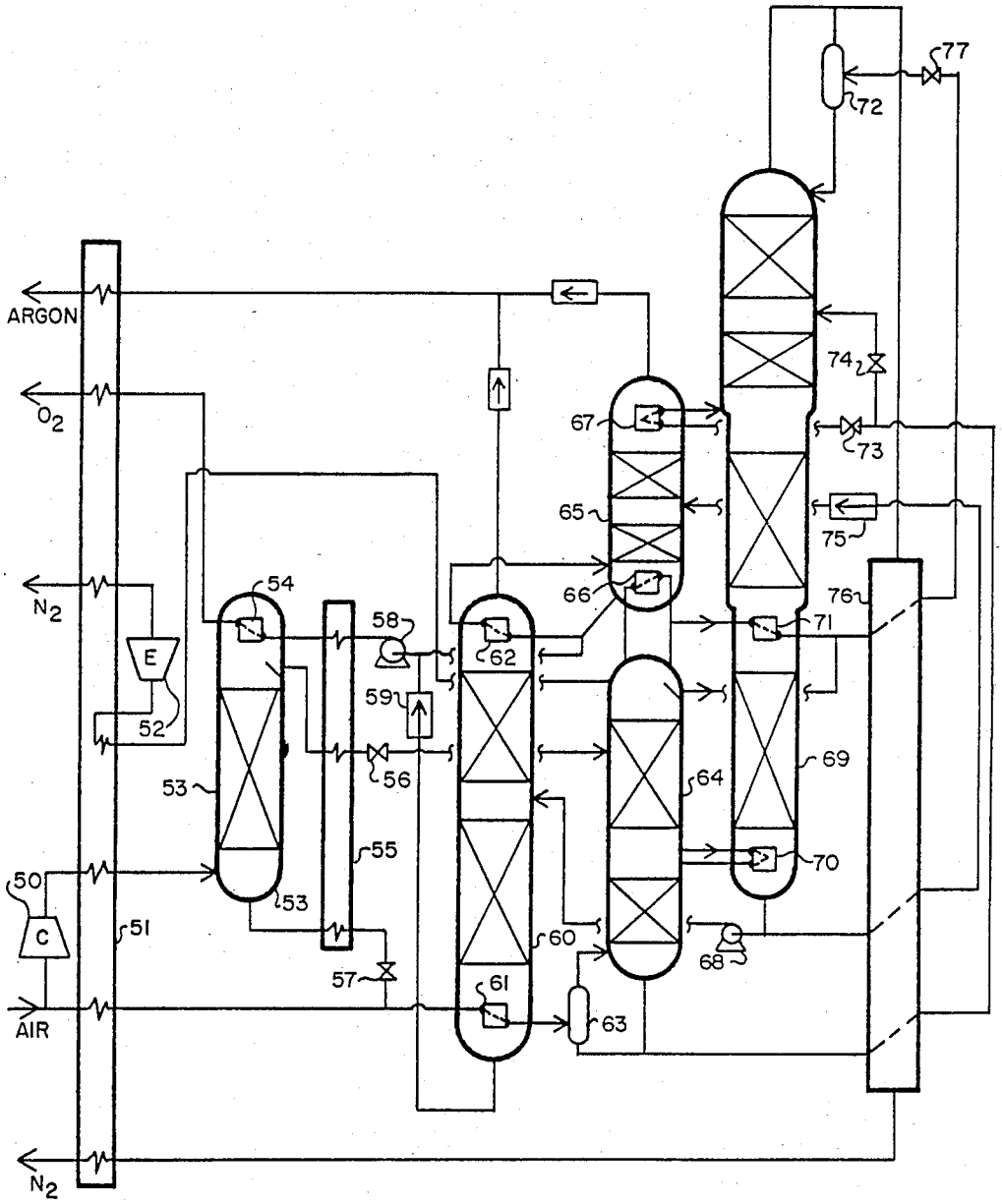
FIG. 3 is a simplified schematic flowsheet of an air separation process incorporating a novel low energy quadruple pressure column flowsheet for producing high purity (~99.5%) oxygen and which also incorporates the disclosed pumped LOX improvement using an elevated pressure rectifier.

A third example of adapting a flowsheet to change its product gaseous oxygen from low pressure to high pressure by incorporating an elevated pressure compressor, elevated pressure rectifier, and LOX pump is presented in FIG. 3. In that figure, a fraction (between 15 and 45%) of the high pressure supply air is further compressed in elevated pressure compressor 50 and then introduced into elevated pressure rectifier 53. Pressurized LOX is boiled in reflux condenser 54 to reflux column 53 and to produce the pressurized gaseous oxygen product. Liquid $N_2$ overhead product and oxygen enriched bottom product is cooled in exchanger 55 against the pumped LOX and then routed respectively through means for pressure reduction 56 and 57 to HP rectifier 64. The oxygen enriched liquid may optionally be routed in conjunction with the remaining fraction of HP air thru reboiler 61 and through optional phase separator 63 before the gaseous fraction finally enters rectifier 64. Overhead gaseous $N_2$ in rectifier 64 is divided between three destinations: part to refrigeration expander 52 (via balance section of main exchanger 51), part to reboiler 66 of low pressure argon-oxygen separation column 65, and part to intermediate reboiler 71 of nitrogen rejection column 69. The bottom of column 69 is reboiled by exchanging latent heat with vapor from an intermediate height of column 64 in reboiler/intermediate refluxer 70. Liquid $N_2$ from reboilers 66 and 71 is divided between providing overhead reflux to column 64 and being routed via subcooler 76, means for pressure reduction 77, and optional phase separator 72 to direct injection reflux for the overhead of column 69. Oxygen enriched liquid bottom product is subcooled in exchanger 76 and then divided between direct feed to column 69 via means for pressure reduction 74 and indirect feed to column 69 via means for pressure reduction 73 and reflux condenser 67. The latter condenser refluxes column 65 and evaporates at least part of the oxygen enriched liquid fed to it prior to injection in column 69. The bottom liquid from column 69, which is reduced to less than about 1% $N_2$ content, and preferably less than 0.2% $N_2$, is also divided: part is raised in pressure via means for pressurization 68 (e.g. a pump) and supplied to medium pressure oxygen-argon separation column 60, and the remainder is subcooled in exchanger 76 and then routed through flow control device 75 to column 65. Thus almost all the nitrogen is rejected from the air stream in column 69 and discharged to atmosphere (or sieve regeneration, etc.) via exchangers 76 and 50. The remaining liquid oxygen-argon mixture is divided between columns 60 and 65, operating at different pressure, which produce oxygen bottom product of specified purity and crude argon overhead product. Column 60 is refluxed by exchanging latent heat between overhead crude argon and liquid oxygen from near or at the bottom of column 65 in reboiler/reflux condenser 62. Thus column 65 has two sources of reboil. The net liquid bottom products from columns 60 and 65 are pressurized to the required $O_2$ delivery pressure via flow control device 59 and pump 58. Flow control devices 59 and 75 may be check valves, pumps, orifices, or other means known to the art, e.g. barometric legs, where vertical distances are the required values.

The crude argon overhead products from columns 65 and 60, being at different pressures, would normally be combined into a single pressure stream, e.g. via means for flow control 78 and 79 or via other means apparent to the artisan.

The artisan will recognize that this flowsheet can accommodate standard variations known in the art, e.g. use of air expansion vice $N_2$ expansion for producing refrigeration, use of reversing exchangers for moisture and $CO_2$ removal, alternate configurations of subcooling heat exchangers, and the like. It is not necessary to withdraw all oxygen at high purity or at high pressure—split product streams are possible. Only a simplified arrangement which highlights the novel aspects of the disclosure has been presented—details such as instrumentation, hydrocarbon adsorbers, equipment bypasses, multiple column feed and withdrawal points, and the like have been omitted. When mol sieve air drying is used it can be applied to each supply pressure, or there can be only a single pressure system at high pressure whereby the elevated pressure compressor compresses already dried air. A krypton and xenon recovery section may be incorporated, e.g. according to U.S. Pat. No. 4,401,448. The fraction of air supplied at high pressure to the above flowsheet can be at an exceptionally low pressure, e.g. between 3.5 and 5 ATA, resulting in very low energy consumption for the separation. This is because there are a small number of trays and hence low pressure drop across the nitrogen rejection column, and also because the HP rectifier overhead reboils it at a location where there is still appreciable nitrogen content. Normally in such a configuration there is insufficient reboil remaining for the argon separation column to achieve high purity oxygen. However in the disclosed configuration only about 4% argon must be removed from the liquid oxygen bottom product from the $N_2$ rejection column, and the combination of the two argon removal columns in parallel is more than adequate to do this. The key addition is the medium pressure argon removal column 60, which is reboiled by that part of the latent heat from the supply air which is not necessary for the separation being performed in rectifier 64. Note that the air only partially condenses in reboiler 61.

Example operating conditions for the FIG. 3 flowsheet are as follows. Given a supply rate of 100 moles/-second (ms) of clean high pressure air at a pressure of 4.4 ATA, and a pressurized oxygen production rate of 20.5 ms at 6 ATA and 99.5% purity, approximately 32 ms of the air is further compressed to an elevated pressure of 18 ATA. Sixteen ms $LN_2$ and 16 ms oxygen enriched liquid are heat exchanged against the 20.5 ms of pressurized liquid oxygen. The reboil rate of column 60 is 5 ms, and it operates at a bottom pressure of 1.68 ATA and top pressure of 1.5 ATA. The reboil rate at the bottom of column 69 is 11.5 ms, and it operates between 1.35 ATA (bottom) and 1.15 ATA (top). Above reboiler 71 the reboil rate increases to 21 ms. 3.5 ms of liquid oxygen-argon mixture is pumped to column 60, and the remaining 18 ms is routed to column 65, which operates between 1 ATA (bottom) and 0.8 ATA (top). The crude argon may be pumped or compressed as desired to raise its pressure above atmospheric. Note that although column 65 is illustrated as being refluxed by exchanging latent heat with kettle liquid, it could equally as well be refluxed by exchanging latent heat with an intermediate height of column 69.

As mentioned earlier, any other low pressure gaseous oxygen-producing distillation configuration can be adapted to incorporate this invention, including liquid recycle column configurations, vapor recycle configurations, the configuration disclosed in U.S. Pat. No. 3,688,513, and others. The pressurized oxygen from this process may be further compressed to delivery pressures above 10 ATA. Any of the distillations involved can be of the non-adiabatic type, such as disclosed in U.S. Pat. No. 3,508,412 and elsewhere. Any oxygen purity can be accommodated, including more than one purity from the same process. The elevated pressure rectifier may be accompanied by a "parallel" oxygen-argon separating column just as the HP rectifier 64 is accompanied by parallel column 60. Parallel means they operate between similar temperatures or share heat sources and heat sinks. The scope of the disclosed invention, which extends to all embodiments described above and obvious variants thereof, is defined by the claims.

I claim:

1. A cryogenic distillation process for producing oxygen comprising:

(a) withdrawing gaseous oxygen at a product pressure of up to about 10 ATA from a latent heat exchanger;

(b) supplying a fraction of air that has been cleaned and cooled to near its dewpoint at an elevated pressure that is at least approximately $2\frac{1}{2}$ times the oxygen product pressure to an elevated pressure rectification column;

(c) rectifying the elevated pressure air to a liquid $N_2$ over-head product and an oxygen enriched liquid bottom product;

(d) refluxing the elevated pressure rectifier by indirect heat exchange in said latent heat exchanger with boiling pressurized liquid oxygen, whereby said gaseous oxygen at product pressure is obtained;

(e) supplying said liquid nitrogen, said oxygen enriched liquid, plus a remaining fraction of air at a high pressure that is at least 2 ATA lower than said elevated pressure to a cryogenic distillation apparatus;

(f) distilling said fluids from step (e) so as to obtain low pressure liquid oxygen;

(g) pressurizing said low pressure liquid oxygen for use in step (d), while precluding the requirement for a mechanical gaseous oxygen compressor.

2. The process according to claim 1 wherein the elevated pressure fraction of air comprises between 15 and 40% of the total air supplied to the process.

3. The process according to claim 2 wherein the cryogenic distillation apparatus is comprised of a dual pressure column.

4. The process according to claim 2 wherein the cryogenic distillation apparatus is comprised of a high pressure rectifier, a nitrogen rejection column and at least one additional column which separates argon from the oxygen.

5. The process according to claim 4 further comprising rectifying said supply fluids into liquid $N_2$ and oxygen enriched liquid in said HP rectifier, distilling said oxygen enriched liquid to a liquid oxygen-argon mixture in said nitrogen rejection column, and distilling said liquid oxygen-argon mixture to said low pressure liquid oxygen in said at least one additional column.

6. The process according to claim 5 further comprising providing two columns for separating argon from oxygen, supplying part of said oxygen-argon mixture to each, reboiling one argon separation column by latent heat exchange with HP rectifier overhead gas and the other by latent heat exchange with partially condensing high pressure air, and obtaining said low pressure liquid oxygen from the bottom products of the two argon separation columns.

7. The process according to claim 6 comprising operating one argon separation column at about 1 ATA, operating the other at about 1.5 ATA, and producing oxygen of at least 99.5% purity.

8. In a process for producing pressurized gaseous oxygen comprising:

(a) supplying a major fraction of air at a high pressure and the remainder at an elevated pressure;

(b) gasifying pressurized liquid oxygen by indirect heat exchange against condensing elevated pressure air;

(c) supplying the high pressure air plus the liquid from step (b) to a subambient distillation process;

(d) pumping liquid oxygen obtained from the subambient distillation process to the pressure required in step (b); the improvement comprising:

(i) providing an elevated pressure rectification column;

(ii) refluxing the elevated pressure rectifier by indirect heat exchange with said boiling pressurized liquid oxygen;

(iii) withdrawing as product the resulting gaseous oxygen at a pressure up to about 10 ATA while precluding the requirement of mechanical compressing of the gaseous oxygen to that pressure;

(iv) supplying said elevated pressure air to said elevated pressure column, whereby liquid nitrogen and oxygen enriched liquid are obtained;

(v) using said liquid nitrogen as reflux in and further separating said oxygen enriched liquid in said subambient distillation process.

9. The process according to claim 8 further comprising providing for the subambient distillation an HP rectifier, MP column, and LP column; reboiling both the MP and LP columns by indirect heat exchange with condensing HP rectifier overhead; refluxing both the MP and LP columns with condensed HP rectifier overhead;, routing HP rectifier bottom product to the MP column for further enrichment; and routing the MP column bottom liquid to the LP column for final separation.

10. An apparatus for producing pressurized gaseous oxygen comprising:

(a) a means designed for providing split supply pressure air, one fraction at a high pressure, and the remaining fraction at an elevated pressure which is at least 2 ATA higher than said high pressure;

(b) an elevated pressure rectifier which rectifies the elevated pressure air fraction to liquid $N_2$ and oxygen enriched liquid;

(c) a means for pressurizing liquid oxygen;

(d) a reflux condenser for the elevated pressure rectifier which gasifies the pressurized liquid oxygen;

(e) a cryogenic distillation apparatus which is supplied the high pressure air fraction and the liquid $N_2$ and oxygen enriched liquid from the elevated pressure rectifier and which produces the liquid oxygen which is pressurized in the means for pressurization;

(f) a means designed for withdrawing said gasified pressurized liquid oxygen at a product pressure of up to about 10 ATA, said means including means for precluding a mechanical gaseous oxygen compressor.

11. Apparatus according to claim 10 wherein the pressurized oxygen pressure is between 2 and 10 ATA, the high pressure is between 3 and 6 ATA, and the elevated pressure is at least $2\frac{1}{2}$ times the pressurized oxygen pressure.

12. Apparatus according to claim 11 wherein the cryogenic distillation apparatus is comprised of a high pressure rectifier which receives said supply fluids, a nitrogen rejection column which is reboiled by latent heat exchange with the HP rectifier, and at least one column which separates argon from oxygen and supplies liquid oxygen to said means for pressurizing.

13. Apparatus according to claim 12 comprising two columns for separating argon from oxygen and means for dividing the liquid bottom product from the nitrogen rejection column into supply for both argon separating columns.

14. Apparatus according to claim 13 comprising means for reboiling one of said argon separating columns by latent heat exchange with HP rectifier overhead vapor; means for reboiling another argon separating column by latent heat exchange with partially condensing high pressure air, and means for refluxing the latter argon separation column by latent heat exchange of its overhead vapor with bottom liquid of the former argon separation column.

15. Apparatus according to claim 14 wherein the HP rectifier pressure is about 4.2 ATA, the $N_2$ rejection column pressure is about 1.3 ATA, the two argon separation columns are at about 0.9 ATA and 1.5 ATA respectively.

* * * * *